United States Patent [19]

Lee

[11] 3,971,436

[45] July 27, 1976

[54] CEMENTING HEAD

[75] Inventor: William T. Lee, Harvey, La.

[73] Assignee: Fishing Tools, Inc.

[22] Filed: Feb. 25, 1975

[21] Appl. No.: 552,799

[52] U.S. Cl. ..... 166/70; 166/155

[51] Int. Cl.[2] ..... E21B 33/05

[58] Field of Search ..... 166/70, 152, 224, 155, 166/156

[56] References Cited

UNITED STATES PATENTS

| | | | |
|---|---|---|---|
| 2,630,179 | 3/1953 | Brown | 166/70 |
| 2,647,582 | 8/1953 | Brown et al. | 166/70 |
| 3,444,928 | 5/1969 | Pitts | 166/70 |

*Primary Examiner*—James A. Leppink
*Attorney, Agent, or Firm*—Pravel & Wilson

[57] ABSTRACT

A cementing head for use in the cementing of casing in a wellbore, wherein means are provided internally of a tubular housing for normally directing drilling fluid or mud through the cementing head prior to introducing cement therethrough, and wherein cement control means are also disposed internally of the tubular housing for regulating and controlling the introduction of a first cementing plug in advance of cement, followed by a second cement plug, and with means for thereafter pumping drilling fluid or mud down to wash out the cement from the cementing head while forcing the second cementing plug down the casing above the cement.

19 Claims, 11 Drawing Figures

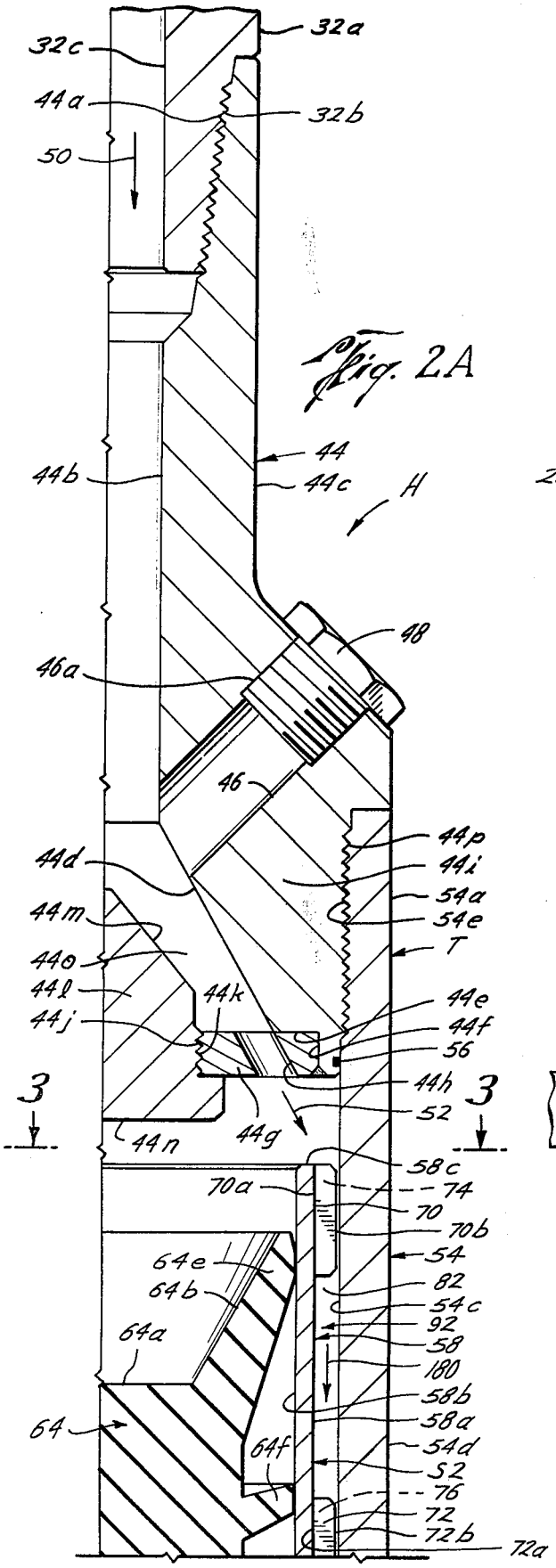
Fig. 2A
Fig. 1
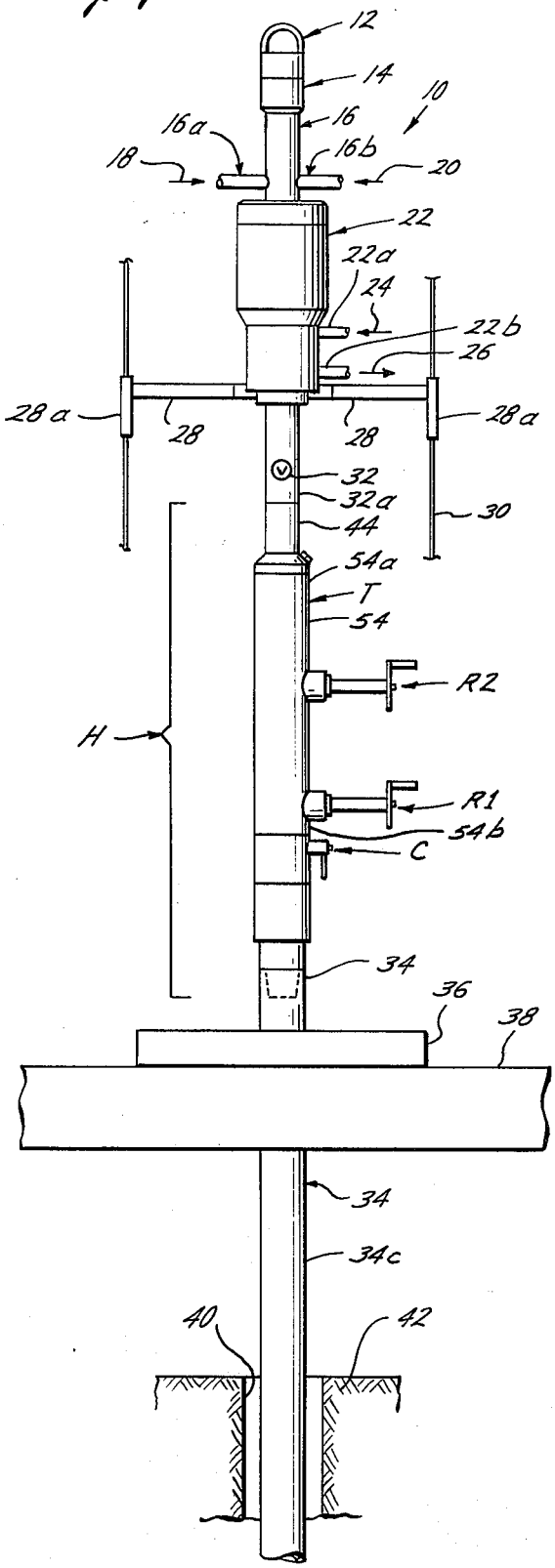

58c
70
70a
74
70b
T
H
82
S2
200
58a
58b
58
92
112
R2
124
72
72a
72b
76
134
120
84
64e
64b
114
116
130
64a
132
60c
58d
66b
64
78
66
66a
195
64f
86
60
64g
60a
90
64h
60b
64i
S1
68
68b
68a
80
64d
94
64c
104
141b
141a
R1
96
139
194
95
97
88
60d
108
54b
140
146f

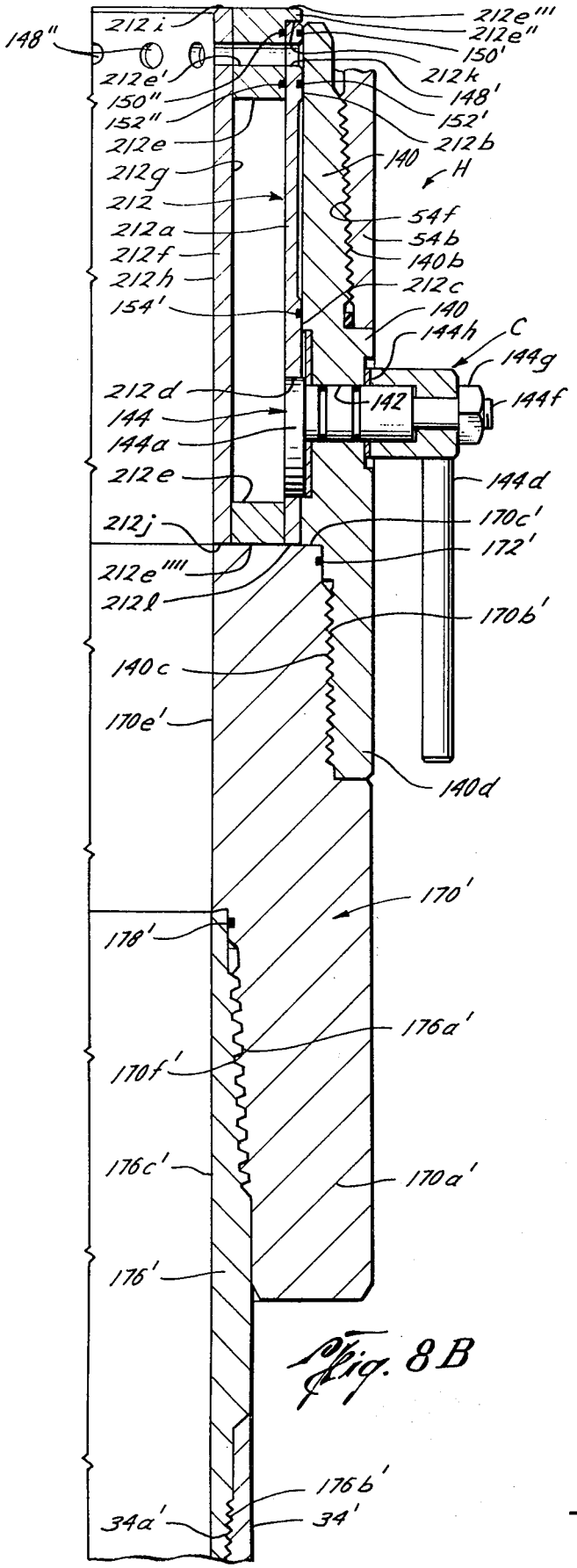
Fig. 8B
Fig. 7
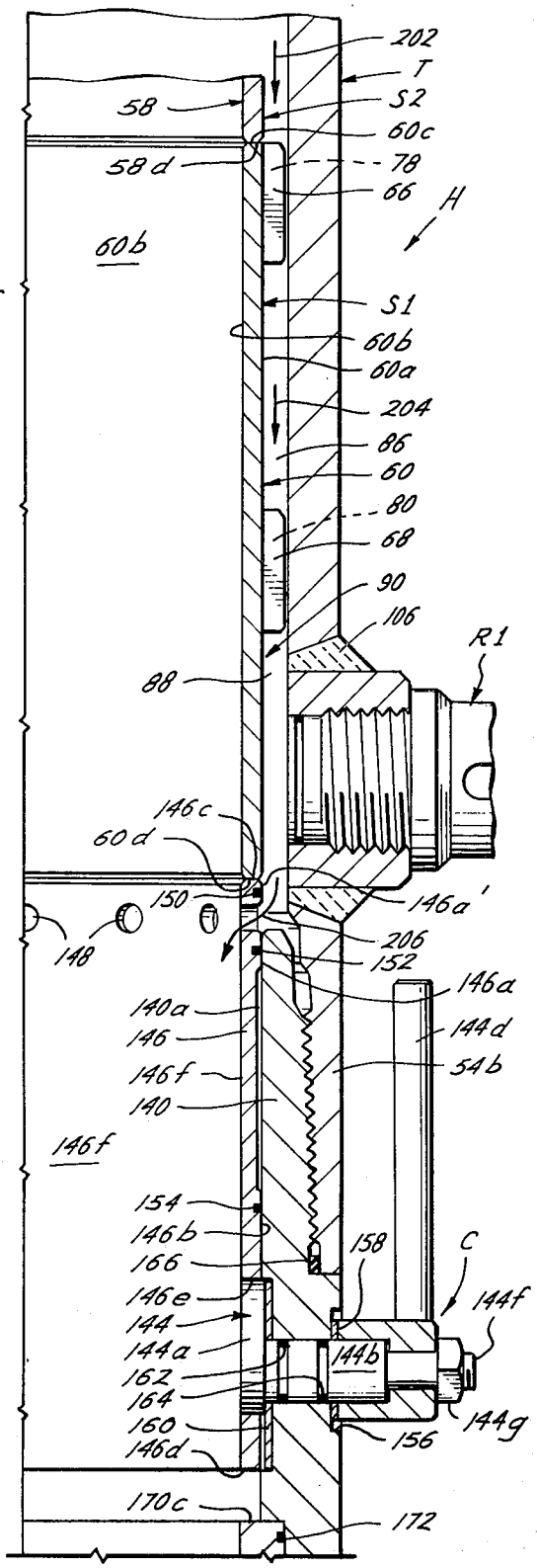

CEMENTING HEAD

BACKGROUND OF THE INVENTION

The field of this invention is cementing heads, particularly of the type used for the cementing of casing in a wellbore.

The production life of a well is directly affected by the quality of the cementing job. A good cementing job will seal off water zones, isolate producing intervals, control injected fluids during secondary recovery, control well stimulation treatments, protect the outside of the casing from corrosion, reduce the danger of a blowout caused by high pressure gas, help prevent loss of drilling mud up and around the outside of the casing and give added strength to the casing to help prevent collapsing due to external pressure. It is therefore extremely essential to have a good cement bond and uniform distribution of the cement on the outside diameter of the casing and on the inside of the wellbore. It must be free of any continuous channels or voids.

The fundamental concepts of displacing the mud or drilling fluid with a cement slurry is based upon a calculated volume of cement slurry being pumped down inside of the casing, out the bottom of the casing, and then up the annular space between the wellbore and the casing's outside diameter. For more efficient mud displacement, the techniques of centralizing the casing, attaching scratchers to the casing, conditioning the mud, proper cement mud density difference and pumping the cement in turbulent flow instead of laminar flow all promote more efficient mud displacement. However, even with these techniques, mud removal from the annular space between the wellbore and the outside diameter of the casing still prevents significant problems.

U.S. Pat. No. 3,777,819 discloses a technique of simultaneously rotating and reciprocating the casing string for the distribution of cement around the casing within the wellbore. The cementing head as disclosed in that patent has extensive external valving and by-pass manifolds which present manufacturing and operational problems.

SUMMARY OF THE INVENTION

The present invention relates to a new and improved cementing head for use in the cementing of casing in a wellbore. The cementing head of this invention preferably includes a tubular housing having a longitudinal bore therethrough and adapted to be mounted having an upper end to be connected for selectively receiving cement and drilling fluid and having a lower end adapted to be connected with the upper portion of the casing. In one aspect of the invention, a flow control means is located internally of a housing for normally by-passing mud or drilling fluid around a cementing plug and for subsequently closing off such flow for introducing cement above the plug to move the plug and cement down into the casing for cementing the casing in the wellbore.

Also, the invention may include a second flow control means for a second cementing plug with suitable by-pass means to control fluid flow of cement and/or mud therearound during normal operations and during the cementing operation, with the flow control means being movable to a position for closing off such flow and directing it for the purpose of forcing the second plug to follow the cement.

To assure the removal of cement from the apparatus after the cementing operation, a cleanout mechanism may be incorporated as a part of the apparatus for directing fluid such as mud into the areas in which the cement passed during its injection.

DESCRIPTION OF THE DRAWINGS

FIG. 1 is an elevational view showing the cement head of the present invention as used with an entire cementing assembly for rotating and reciprocating the casing in a wellbore during cementing operations thereof;

FIG. 2A is an elevational sectional view of the upper portion of the cementing head of the present invention;

FIG. 7 is an elevational sectional view showing the cleanout of the cementing head of the present invention in an actuated, cleaning position;

DESCRIPTION OF THE PREFERRED EMBODIMENT

Figure 2B:
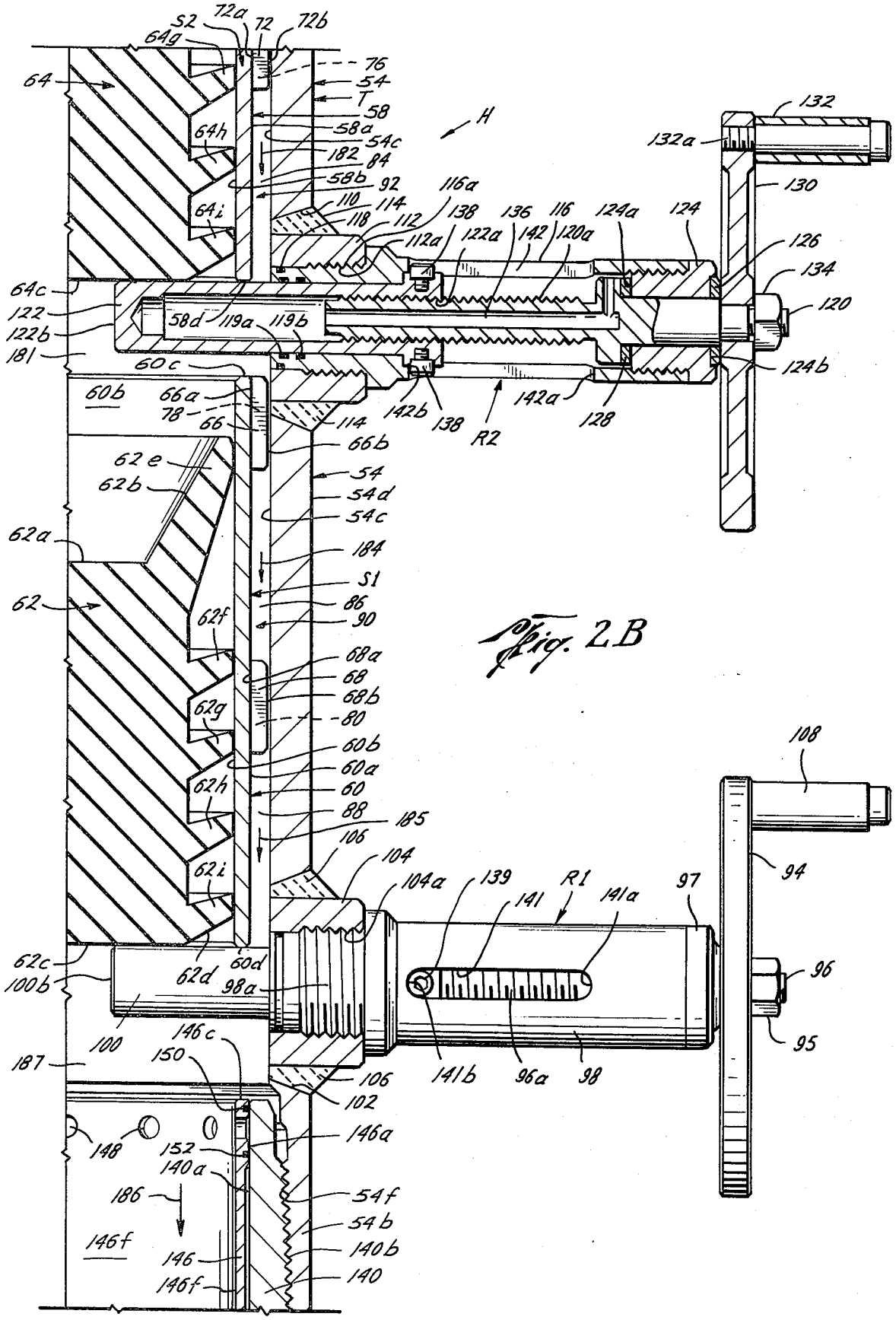
FIG. 2B is an elevational sectional view of the mid-portion of the cementing head of the present invention.

In the drawings, the letter H designates the cementing head of the present invention. The cementing head H includes a tubular housing T, a first plug-receiving sleeve S1 to be mounted within the tubular housing T, a first releasable support R1 mounted with the tubular housing T, a second plug-receiving sleeve S2, a second releasable support R2 and a cleanout means C. Unless otherwise noted, the components of this invention are made of steel capable of taking heavy stresses and strains without failure, although other suitable high-strength materials may be used if desired.

As shown in FIG. 1, the cementing head H of the present invention is adapted to be used with a cementing assembly 10 capable of simultaneously and/or independently rotating and/or reciprocating a casing string to achieve proper distribution of cement between the outer annular surface 34*c* of the casing 34 and the wellbore 40. The cementing head H is disposed intermediate of cementing assembly 10. The cementing assembly 10 includes a lifting bail 12 affixed to an elevator sub 14. A pump-in sub 16 is affixed to the elevator sub 14 and has a cement inlet 16*a* and a mud inlet 16*b* allowing the flow of cement to enter the cement inlet 16*a* in the direction of arrow 18 and the flow of mud to enter the mud inlet 16b in the direction of arrow 20 to flow into the inner bore of the pump-in sub 16 of the cementing assembly 10. Preferably, a power swivel 22 is affixed beneath the pump-in sub 16 for providing power and rotational freedom for the remaining portion of the cementing assembly 10. The power swivel 22 is hydraulically powered, having a hydraulic inlet 22a and a hydraulic outlet 22*b* for providing the hydraulic motive incoming force in the direction of arrow 24 and exhausting the spent hydraulic fluid in the direction of arrow 26. The power swivel 22 is the subject of a copending application by the same inventor and filed contemporaneous with this application. Torque arms 28 are affixed thereto the power swivel 22 having end portions 28*a* adapted to slidably receive heavy-duty guide cables 30 so that the entire assembly can move reciprocally while the torque arms prevent rotation of the power swivel 22 when being so powered. A ball valve housing 32a having a ball valve 32 therein is affixed beneath the power swivel 22 for emergency situations in which it is necessary to sever all flow within the cementing assembly 10. Thereunder the ball valve housing 32*a*, the cementing head H of the present invention is appropriately affixed thereto, which will be discussed more fully hereinbelow. Adjacent the lower end of the cementing head H, a tubular member such as casing 34 is appropriately affixed. The casing 34 extends through the rotary table 36 and the platform 38 of the drilling rig and thereinto the wellbore 40 formed in the ground surface 42. Thus, the entire cementing assembly 10 may be lifted and lowered reciprocally by attachment to the lifting bail 12 while the power swivel 22 in conjunction with the rotary table 36 provides rotational power for rotating the entire cementing assembly 10 including the cementing head H and casing 34.

Figures 2C, 3, 4:
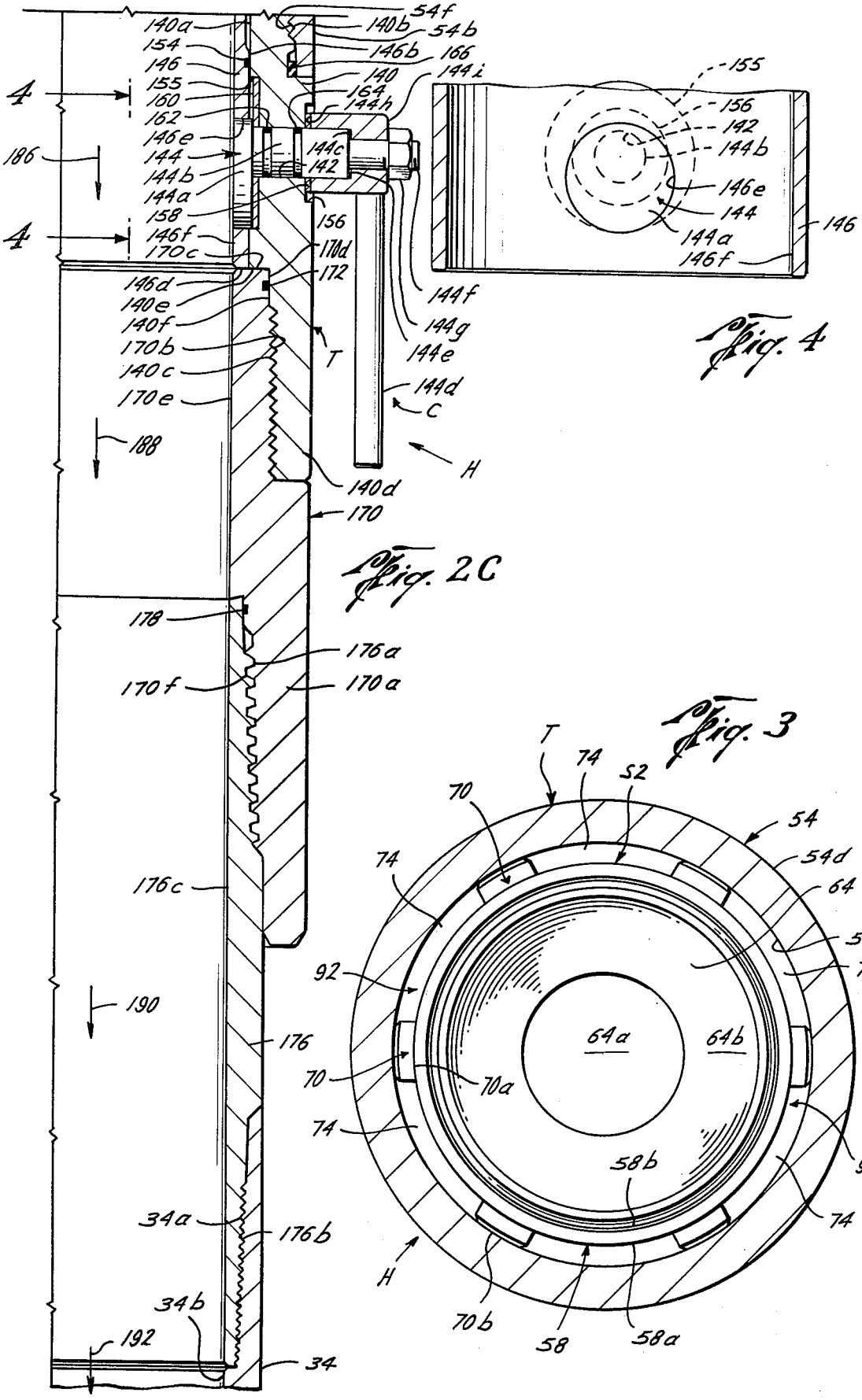
FIG. 2C is an elevational sectional view of the lower portion of the cementing head of the present invention.
FIG. 3 is a plan view of the cementing head of the present invention, taken along the lines 3—3 of FIG. 2A.
FIG. 4 is an elevational sectional view of the eccentric cam of the cleanout of the cementing head of the present invention, taken along the lines 4—4 of FIG. 2C.

The cementing head H of the present invention is shown in FIGS. 2A, 2B and 2C in a sectional elevational view. As shown in FIG. 2A, the cementing head H includes a tubular housing T. The tubular housing T includes an upper joining member 44 which threadedly engages the lower portion of the ball valve housing 32*a* at threads 44*a* and 32*b*, respectively. The upper joining member 44 has a bore 44*b* therein which is in substantial concentric alignment with the bore 32*c* of the ball valve housing 32*a*. An emergency port 46 is formed in the upper joining member 44 in fluid communication with the bore 44*b*. The emergency port 46 has threads 46*a* adjacent to the outer annular surface 44*c* of the upper joining member 44 adapted to threadedly receive emergency port closure 48. The emergency port 46 provides a pump-in location for fluid and/or mud should closure of the ball valve 32 be necessitated because of any leakage therebetween any connections thereabove and/or washpipe (not shown) packing failure in the power swivel 22.

The bore 44*b* of the upper joining member 44 expands radially outwardly in the vicinity of the emergency port 46 forming an inverted funnel portion 44*d*. Surfaces 44*e* and 44*f* are formed adjacent to funnel portion 44*d* for receiving a fluid deflector 44*g* having an inclined opening 44h formed therein. The deflector

44*g* is mounted with the lower portion 44*i* of the upper joining member 44 by welding or any other suitable means adjacent to surfaces 44*e*, 44*f*. Preferably, the inclined opening 44*h* follows substantially the same inverted funnel configuration of funnel portion 44*d*. The deflector 44*g* further includes threads 44*j* for threadedly receiving threads 44*k* of deflector support 44l.

The deflector support 44l has external surfaces 44*m* and 44*n* formed therewith. The external surfaces 44*m* and funnel portion 44*d* provide for the outermost portions of deflector chamber 44*o*. Fluid entering in the direction of arrow 50 from the ball valve housing 32*a* into the upper joining member 44 enters into the bore 44*b* of the same and is directed through deflector chamber 44*o* and outwardly therefrom through inclined opening 44*h* formed in fluid deflector 44*g* in the direction of arrow 52. Thus, fluid exiting inclined opening 44*h* is directed towards the inner bore surface 54*c* of the tubular housing T.

The tubular housing T further includes a tubular central housing 54 having an upper end 54*a* and a lower end 54*b* with an inner annular surface 54*c* and an outer annular surface 54*d*. The central tubular housing 54 is threadedly affixed to the upper joining member 44 by threads 54*e* threadedly engaging threads 44*p*, respectively, and sealably engaged by an appropriate seal 56 to prevent fluid leakage therebetween.

A first plug-receiving sleeve S1 is adapted to be disposed within the inner bore 54*c* of the central housing 54. The first plug-receiving sleeve S1 includes a first sleeve 60 having an outer cylindrical surface 60*a*, a longitudinal bore 60*b*, an upper annular surface 60*c*, and a lower annular surface 60*d*. Similarly, a second plug-receiving sleeve S2 is adapted to be disposed within the inner bore 54*c* of the central housing 54 and includes a second sleeve 58 having an outer cylindrical surface 58*a*, a longitudinal bore 58*b*, an upper annular surface 58*c*, and a lower annular surface 58*d* (FIG. 2B). Preferably, the first sleeve 60 and the second sleeve 58 are of a solid tubular cylindrical configuration, however, other configurations, for example slotted or ported configurations, may be used.

The first plug-receiving sleeve S1 is adapted to receive a first cement plug 62 within the longitudinal bore 60b of the first sleeve 60. In similar fashion, the second plug-receiving sleeve S2 is adapted to receive a second cement plug 64 within the longitudinal bore 58*b* of the second sleeve 58. The cement plugs 62, 64 are well known in the art and may be of the type manufactured by Halliburton Corporation and noted on page 2045 of the 1974–1975 Composite Catalog, however, any other suitable cementing plug may be used. The cementing plugs 62, 64 include upper surfaces 62*a*, 64*a* and 62*b*, 64*b*, lower surfaces 62*c*, 64*c* and 62*d*, 64*d* and radially extending fin portions 62*e*, 64*e*, 62*f*, 64*f*, 62*g*, 64*g*, 62*h*, 64*h* and 62*i*, 64*i*, respectively. The fin portions 62*e–i*, 64*e–i* are adapted to sealably engage the inner bores 60*b*, 58*b* of the first sleeve 60 and the second sleeve 58, respectively, as will be discussed more fully hereinbelow.

A plurality of centralizing lugs 66, 68 are radially disposed about the outer cylindrical surface 60*a* of the first sleeve 60 with the centralizing lug 66 being mounted adjacent the upper annular surface 60c and the centralizing lug 68 being mounted approximately midway therebetween the annular surfaces 60*c*, 60*d*. In similar fashion, centralizing lugs 70, 72 are mounted with the outer cylindrical surface 58*a* of the second sleeve 58 such that centralizing lug 70 is mounted adjacent to the upper annular surface 58*c* and centralizing lug 72 is mounted approximately midway between the annular surfaces 58*c*, 58*d*. As shown in FIG. 3, the centralizing lugs 70 are radially disposed about the outer cylindrical surface 58*a* of the second sleeve 58 being typically mounted to the second sleeve 58 adjacent lug surface 70*a* and having outer lug surface 70*b* in close proximity to the inner bore 54*c* of the central tubular housing 54. The location and configuration of centralizing lugs 70 are typical of the other remaining centralizing lugs 66, 68, 70. Preferably, the centralizing lugs 66, 68, 70, 72 are welded to or otherwise mounted with the respective sleeves 60, 58 and provide for centralizing the sleeves 60, 58 within the inner bore 54*c* of the central housing 54.

As best shown in FIG. 3, the centralizing lugs 70 provide a series of annular chambers 74 therebetween adjacent centralizing lugs 70 for providing fluid passageways therebetween adjacent centralizing lugs 70, outer cylindrical surface 58*a* of second sleeve 58, and the inner bore 54*c* of the central housing 54. Similar annular chambers 76, 78, and 80 are formed between adjacent centralizing lugs 72, 66, and 68. Furthermore, annular chamber 82 is formed therebetween centralizing lugs 70, 72, the outer cylindrical surface 58*a* of the second sleeve 58, and the inner bore 54*c* of the central tubular housing 54. Annular chamber 84 is formed therebetween centralizing lug 72, the area adjacent to the lower annular surface 58*d* of the second sleeve 58, the outer cylindrical surface 58*a* of the second sleeve 58, and the inner bore 54*c* of the central housing 54. Annular chamber 86 is formed therebetween centralizing lugs 66, 68, the outer cylindrical surface 60*a* of the first sleeve 60, and the inner bore 54*c* of the central housing 54. Annular chamber 88 is formed therebetween the centralizing lug 68, the outer area adjacent to the lower annular surface 60*d* of the first sleeve 60, the outer cylindrical surface 60*a* of the first sleeve 60, and the inner bore 54c of the central housing 54. As such, the annular chambers 78, 86, 80, and 88 form the first by-pass chamber 90. Similarly, annular chambers 74, 82, 76, and 84 form the second by-pass chamber 92 (FIGS. 2A, 2B, 5, 6).

The cementing head H of the present invention further includes a first releasable support R1 and a second releasable support R2 mounted with the tubular housing T (FIG. 2B). The first releasable support R1 includes a crank 94 mounted on a shaft 96 and removably secured thereto by a nut 95, the shaft 96 having threads 96*a* which are protected by a protective housing 98. The threads 96*a* of the shaft 96 threadedly engage correspondingly receptive threads (not shown) internal to the pin 100. A suitable opening 102 is formed in the central housing 54 and adapted to receive support bracket 104 which is suitably mounted with the central housing 54 by weldments 106 or by any other suitable means. The support bracket 104 has threads 104*a* adapted to receive the threaded portion 98*a* of the protective housing 98. A handle 108 is affixed to the crank 94 for facilitating rotational movement of the shaft 96 for retractive movement of the pin 100. It will be appreciated that the first releasable support R1 and the second releasable support R2 are substantially identical in construction. The second releasable support is adapted to be mounted in opening 110 appropriately formed in the central housing 54 and adapted to receivably mount support bracket 112 therein by weldments 114 or by any other suitable means. Protective housing 116 threadedly mounts into the threaded portion 112a by threads 116*a* and is appropriately sealed by seals 118, 119*a*, 119*b* to prevent any fluid leakage therebetween. Shaft 120 extends therethrough the protective housing 116 having threads 120*a* formed therewith for threadedly mounting threads 122*a* of pin 122. The shaft 120 is receivably mounted within collar 124 having appropriate seals 128, 126 adjacent each annular surface 124*a*, 124*b*, respectively, of the collar 124 to prevent fluid leakage therebetween. A crank 130 is removably mounted with the shaft 120 by bolt 134 or any other suitable means. A handle 132 is threadedly mounted with threads 132*a* or any other suitable fashion to the crank 130 to provide ease of rotation thereof. An appropriate lubrication passage 136 is formed within the shaft 120 to provide proper lubrication for the threads 120*a*, 122*a* of the shaft 120 and pin 122, respectively. Furthermore, mechanical stops 138 limit the amount of travel of the pin 122 from its innermost and outermost positions and also act as keys to hold pin 122 from rotating for proper functioning of the threads 120a of the shaft 120 of the second releasable support R2. Similar mechanical stops 139 are mounted with the first releasable support R1. Rotation of the handles 108, 132 of the first releasable support R1 and the second releasable support R2, respectively, results in the retraction of the pins 100, 122, respectively, within their respective protective housings 98, 116 such that the pin end portions 100*b*, 122*b* substantially correspond to the inner bore 54*c* of the central housing 54 as the mechanical stops 139, 138, respectively, engage the outside slotted corners 141*a*, 142*a*, respectively (FIG. 2B).

As shown in FIGS. 2B and 2C, the cementing head H of the present invention further includes a cleanout means C. The cleanout means C includes a tubular member 140 having an opening 142 formed therein and adapted to receive a camming means 144. A third sleeve 146 is adapted to be disposed within the inner bore 140*a* of the tubular member 140. The third sleeve 146 has an upper cylindrical surface 146*a*, lower cylindrical surface 146*b*, upper annular surface 146*c* and lower annular surface 146*d*. A plurality of openings or ports 148 are formed adjacent the upper cylindrical surface 146*a* of the third sleeve 146 and extend radially outwardly from the inner surface 146*f* to the outer upper cylindrical surface 146*a* of the third sleeve 146. Upper cylindrical surface 146*a* and lower cylindrical surface 146*b* of the third sleeve 146 are movably mounted within the inner bore 140*a* of the tubular member 140 having appropriate seals 150, 152, 154 therebetween to prevent unwanted fluid migration therebetween.

The third sleeve 146 has a circular opening 146*e* formed therein and adapted to receive the camming means 144 as shown in FIG. 4. The camming means 144 includes a cam 144*a* being preferably of a circular configuration or of any other suitable configuration and is slightly less than the diameter of the opening 146*e* formed in the third sleeve 146. The cam 144*a* is mounted with a shaft 144*b* within the opening 142 formed within the tubular member 140. The shaft 144*b* extends outwardly from the tubular member 140 having an appropriate lip 144*e* for receiving a handle 144*d* having an appropriately formed indent 144*c* such that the indent 144*c* corresponds to the lip 144*e* on shaft 144*b* with a threaded portion 144*f* of the shaft 144*b* adapted for mounting a nut 144*g* thereto to secure the handle 144*d* thereon. An indent opening 155 concentric with opening 142 is formed on the inner bore 140*a* of the tubular member 140. An indent opening 156 concentric with indent opening 155 is formed in the tubular member 140 and is further formed concentric with opening 142 and is adapted to receivably mount the base portion 144*i* adjacent the lip 144*c* of the handle 144*d*. Interior surface 144*h* of the handle 144*d* is sealably mounted with the indent opening 156 by seal 158. In similar fashion the cam 144*a* is sealably mounted with the indent opening 155 by seal 160 disposed therebetween. Furthermore, seals 162, 164 sealably mount shaft 144*b* with the opening 142 formed in the tubular member 140. As is noted in FIGS. 2C and 4, the cam 144*a* does not extend within the inner bore 146*f* of the third sleeve 146 but substantially parallels the inner bore 146*f* thereof.

The tubular member 140 is threadedly mounted with the lower end 54*b* of the central housing 54 with threads 140*b* of the tubular member 140 engaging threads 54*f* of the central housing 54 and having seal 166 mounted therebetween to prevent fluid migration therebetween. Typical casing-type threads 140*c* are formed adjacent the lower end 140*d* of the tubular member 140 with indent annular surface 140*e* and cylindrical surface 140*f* formed adjacent to the uppermost portion of the threads 140*c*.

Figure 5:
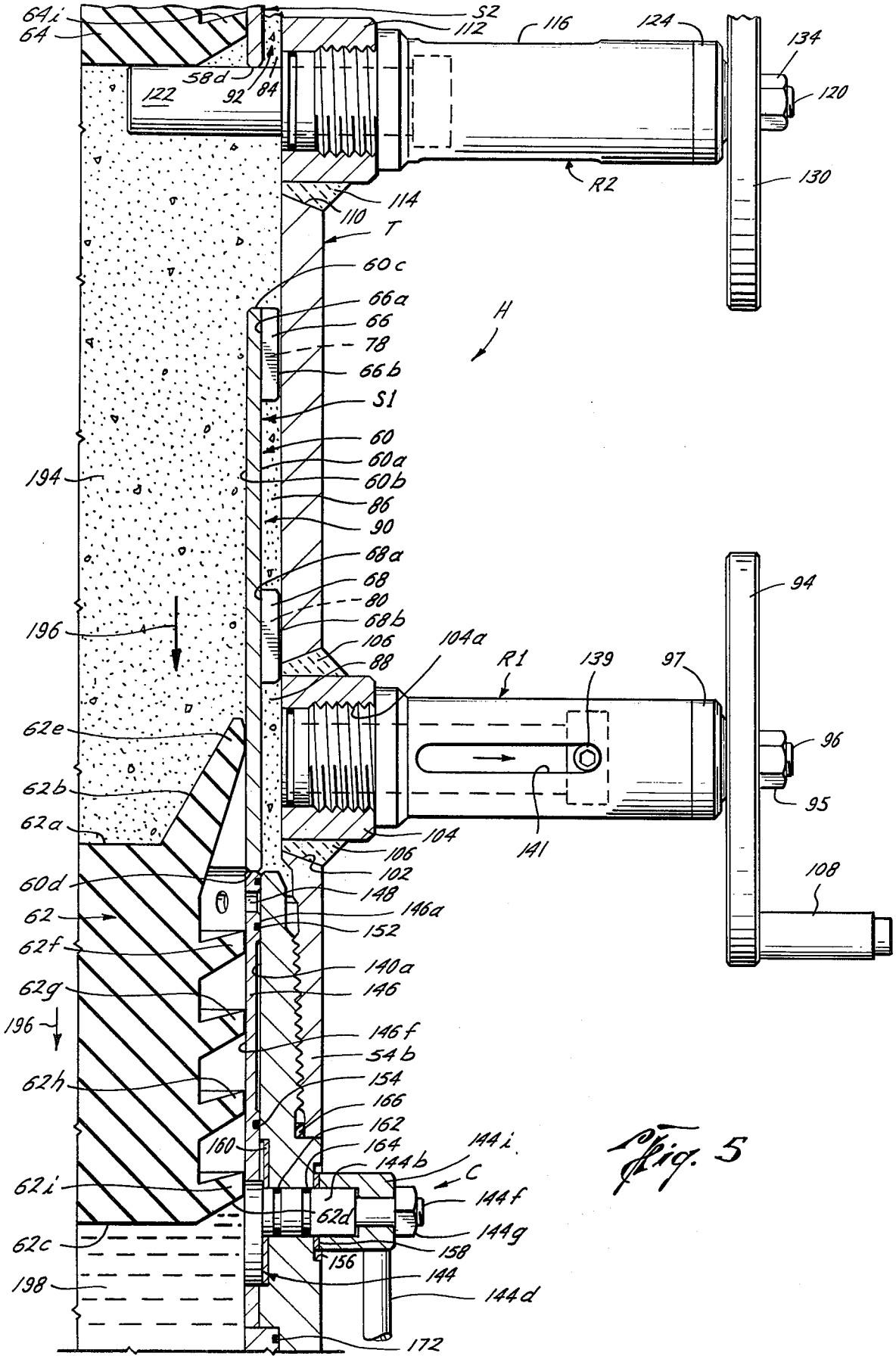
FIG. 5 is an elevational sectional view of the first plug-receiving sleeve in a cementing position for permitting cement pumpage therethrough the inner bore of the tubular housing into the inner bore of the casing.

A connector means 170 includes a tubular connector member 170*a* having upper threads 170*b* adapted to engage threads 140*c* of the tubular member 140 for threadedly mounting the tubular connector member 170*a* with tubular member 140. The connector member 170*a* has surfaces 170*c*, 170*d* which correspond to surfaces 140*e*, 140*f* of the tubular member 140 such that when the connector member 170*a* is threadedly affixed to the tubular member 140 adjacent surfaces 140*e*, 170*c* and 140*f*, 170d engage one another. A seal 172 prevents fluid migration between surfaces 170*d* and 140*f*. The inner bore 170*e* of the connector member 170*a* is of substantially the same inside diameter as the inside diameter of the inner bore 146*f* of the third sleeve 146 such that the lower annular surface 146*d* of the third sleeve 146 rests on annular surface 170*c* of the connector means 170 providing support therefor (FIGS. 2C and 5).

The connector means 170 further includes threads 170*f* which are not of a typical downhole drilling variety. The threads 170*f* are of a coarse variety to promote ease of coupling and uncoupling the cementing head H of the present invention with the casing 34. A tubular adapter 176 having correspondingly rough-cut upper threads 176*a* and typical casing-type lower threads 176*b* is disposed therebetween the connector means 170 and the casing 34 with an appropriately placed seal 178 to prevent fluid migration therebetween the threaded connection of rough-cut, coarse threads 176*a*, 170*f*. The threads 176*b* are adapted to be threadedly connected to threads 34*a* adjacent the uppermost portion of the casing 34.

In the use or operation of the form of the invention illustrated in FIGS. 1 through 7, the cementing head H of the present invention is adapted for use in the cementing of casing 34 in a wellbore 40. Prior to use of the cementing head H for cementing, the cementing head H is substantially in the configuration as noted in FIGS. 2A, 2B, 2C. As described hereinabove, in this position, the first cement shoe 62 and the first plug-receiving sleeve S1 are supported by the first releasable support R1 and the second cement shoe 64 and second plug-receiving sleeve S2 are supported by the second releasable support R2. The cleanout means C is positioned such that the cam 144*a* is in the lowermost position as depicted in FIG. 2C. Typically, a variety of operations can be performed while the cementing head H of the present invention is in this position; for any drilling fluid entering in the direction of arrow 50 from the ball valve housing 32*a* into the upper joining member 44 is directed therethrough the inner bore 44*b* and deflector chamber 44*o* in the direction of arrow 52. At this point, the fluid encounters resistance of the second cement plug 64 as supported by the second releasable support R2. With the second cement plug 64 in sealable engagement with the inner bore 58*b* of the second sleeve 58 by fins 64*e–i*, fluid flowing in the direction of arrow 52 must follow path designated by arrow 180 through the second by-pass chamber 92 (FIG. 2A). The fluid exiting the second by-pass chamber 92 in the direction of arrow 182 (FIG. 2B) flows into the chamber 181 adjacent to the pin 122 which is supporting the second sleeve 58 and second cement plug 64 in an upper position. It is thus apparent that the deflector chamber 44*o* helps to divert and direct fluid under pressure into the by-pass chamber 92. This reduces pressure and stresses on the unsupported pin 122 while channeling the pressurized fluid into the by-pass chamber 92.

The fluid in the chamber 181 thus encounters resistance of the first cement plug 62 within the inner bore 60*b* of the first sleeve 60 and is directed into the first by-pass chamber 90 in the direction of arrow 184, flowing downwardly through the chamber 90 (FIG. 2B). As the fluid exits from by-pass chamber 90 in the direction of arrow 185 into the chamber 187 adjacent the pin 100, no further fluid resistance is encountered, and thus the fluid flows through the inner bore 146*f* of the third sleeve 146 in the direction of arrow 186 (FIGS. 2B, 2C), the inner bore 170*e* of the connector means 170 in the direction of arrow 188 (FIG. 2C), the inner bore 176*c* of the adapter 176 in the direction of arrow 190 and thereinto the inner bore 34*b* of the casing 34 in the direction of arrow 192. Thus fluid entering in the direction of arrow 50 (FIG. 2A) travels along the entire length of the cementing head H and exits therefrom and into the bore 34*b* of the casing 34 in the direction of arrow 192. In this configuration, drilling fluid and/or mud can be circulated throughout the casing 34 without difficulty.

When the time is appropriate for cementing operations to commence, a predetermined volume of cement 194 is pumped into the pump-in sub 16 and thereinto the upper joining member 44 in the direction of arrow 50, through the deflector chamber 44*o* and outwardly therefrom in the direction of arrow 52 (FIG. 2A). At this point, the second releasable support R2 remains undisturbed resulting in the second plug-receiving sleeve S2 and second cement plug 64 therewith blocking the inner bore 58*b* of the second sleeve 58 thus directing the flow of cement 194 in the direction of arrow 180 through the second by-pass chamber 92. However, as the cement exits in the direction of arrow 182 into the chamber 181 adjacent pin 122, the first releasable support R1 is released. Release of the first releasable support R1 is effectuated by cranking crank 94 with handle 108 such that the pin 100 is withdrawn from its position extending thereinto the inner bore 54*c* of the central housing 54. As the handle 108, crank 94 assembly is rotated, the pin 100 is withdrawn until the pin clears the outer cylindrical surface 60*a* of the first plug-receiving sleeve S1. Withdrawal of the pin 100 beyond this outer cylindrical surface 60*a* of the first sleeve 60 results in the first sleeve 60 moving downwardly such that lower annular surface 60*d* of the first sleeve 60 butts upper annular surface 146*c* of the third sleeve 146. The abutment of lower annular surface 60*d* and 146*c* results in sealing off the first by-pass chamber 90 from fluid flow therein and trapping a small volume of cement 194 therein. With the pin 100 withdrawn such that the first sleeve 60 moves from its upper, non-cementing position (FIG. 2B) to a lower, cementing position (FIG. 5), the cement 194 may be pumped downwardly in the direction of arrow 196.

As is well known, the first cement plug 62 contains the cement 194 above surfaces 62*a*, 62*b* while separating the cement 194 from drilling fluid and/or mud 198 adjacent surfaces 62*c*, 62*d* of the first cement plug 62 (FIG. 5). With the inner bores 60*b*, 146*f*, 170*e*, 176*c*, and 34*b* being of substantially the same inside diameter, the first cement plug moves downwardly in response to pressure exerted by the cement 194. Downward longitudinal movement of the first cement plug 62 results in a wiping action wherein the plug fins 62*e*, 62*f*, 62*g*, 62*h*, 62*i* not only sealably separate the cement 194 from the fluid and/or mud 198, but also clean the above-identified respective inner bores as the first cement plug 62 moves downwardly in response to the pressure of the cement 194 thereabove. Furthermore, such action forces the mud and/or fluid 198 outwardly therefrom the inner bore 34*b* of the casing 34 and into the annular space therebetween the outer cylindrical casing surface 34*c* and the wellbore 40. As described hereinabove, during this process, the entire cementing head H is capable of being simultaneously rotated and reciprocated to insure proper cementing and prevent entrapment of mud and/or fluid adjacent to the casing and/or preventing unwanted voids from being formed therebetween the outer casing surface 34*c* and the wellbore 40.

Upon completion of insertion of the predetermined volume of cement 194 into the inner bore 34*a* of the casing 34, it is necessary to pump all of the cement 194 therefrom the inner bore 34*a* of the casing 34 into the annular space therebetween the outer casing surface 34*c* and the wellbore 40. Thus, mud and/or fluid 200 is pumped in by the pump-in sub 16 in the direction of arrow 20 and thereinto the upper joining member 44 in the direction of arrow 50 and is discharged from the deflector chamber 44*o* in the direction of arrow 52 (FIG. 2A). However, at this point, it is desirable not for the incoming mud and/or fluid 200 to mix with the cement 194 for such cement 194 cannot be merely "washed" and/or "pressured" out from the inner bore 34*b* of the casing 34. Thus, it is necessary to release the second releasable support R2.

Figure 6:
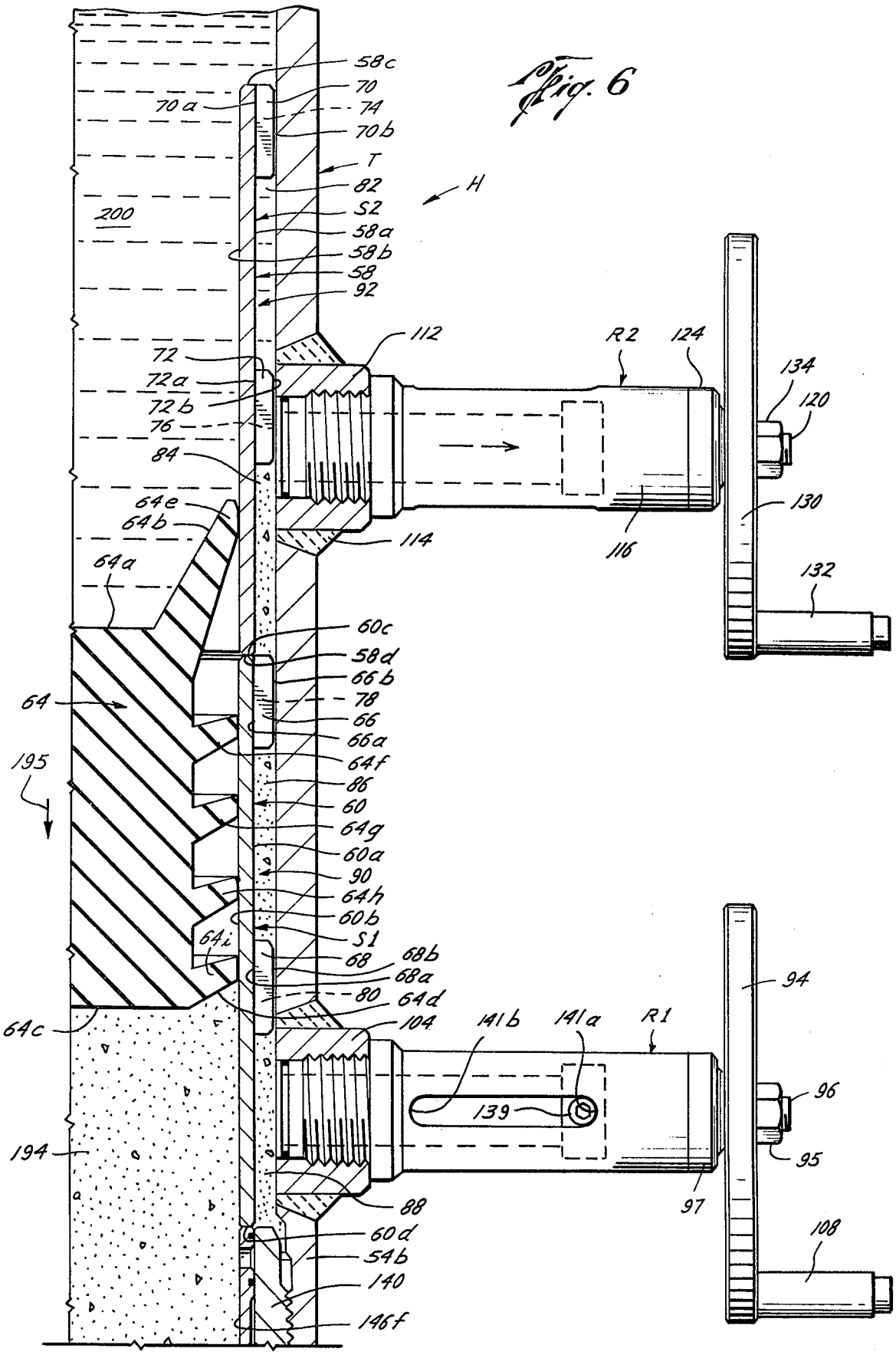
FIG. 6 is an elevational sectional view showing the second plug-receiving sleeve in a lower position for directing the flow of fluid through the bore of the second sleeve.

The releasable support R2 is released by cranking on crank 130 and handle 132 resulting in withdrawal of the pin 122 from its initial position within the bore 54*c* of the central housing 54, to that position pictured in FIG. 6, wherein the pin 122 is entirely withdrawn within the protective housing 116. As the pin 122 is withdrawn inwardly into the protective housing 116 such that the lower annular surface 58*d* of the second sleeve 58 is no longer supported by the pin 122, the second sleeve 58 moves longitudinally into engagement with upper annular surface 60*c* of the first sleeve 60 resulting in a mechanical seal therebetween. Thus, a certain portion of fluid 200 is entrapped within the second by-pass chamber 92 resulting in a cylindrical column being a mixture of entrapped cement within the first by-pass chamber 90 and entrapped mud/fluid 200 within the second by-pass chamber 92.

With the second plug-receiving sleeve S2 being released from its upper position (FIG. 2B) to its lower position (FIG. 6), fluid pressure acts upon surfaces 64*a*, 64*b* of the second cement plug 64 resulting in downward forcing of the second cement plug 64 in the direction of arrow 195. This downward longitudinal movement of the cement plug 64 pressures the cement 194 downwardly through the inner bore 34*b* of the casing 34, with the surfaces 64*c*, 64*d* transmitting the fluid pressure of the fluid 200 on surfaces 64*a*, 64*b* to the cement 194. As described hereinabove with respect to the first cement plug 62, the plug fins 64*e*, 64*f*, 64*g*, 64*h*, 64*i* of the second cement plug 64 seal the cement 194 from the mud and/or fluid 200 while wiping the inner bore surfaces 58*b*, 60*b*, 146*f*, 170*e*, 176*c*, and 34*b* of substantially all cement 194 therein. As described hereinabove, the entire cementing head H of the present invention is adapted to be rotated and reciprocated simultaneously during this operation to promote proper cementing of the casing 34 within the wellbore 40. When the first cement plug 62 reaches the cement shoe (not shown), there will be a pressure kick, or increase, as the cement plug 62 is pumped out. A high-pressure buildup indicates that the second cement plug 64 has reached the bottom of the casing 34 and all of the cement has been displaced from within the bore 34*b* of the casing 34 while simultaneously and/or individually rotating and/or reciprocating the casing 34 to achieve proper distribution of cement 194 and, thereby, reducing the need for remedial workovers of the casing 34.

As noted above, a quantity of cement 194 and fluid 200 are trapped within the first by-pass chamber 90 and the second by-pass chamber 92. For proper maintenance of the cementing head H of the present invention, it is necessary that this excess mixture be discharged so that the cement will not set within the by-pass chambers 90, 92 and damage the operative parts thereof. In order to remove such cement-fluid mixture, the cleanout means C must be activated (FIG. 7). For activation of the cleanout means C, it is necessary that the camming means 144 be rotated. Rotation of handle 144*d* results in rotation of shaft 144*b* and the ensuing rotation of cam 144*a* which is rotatably mounted with the opening 146*e* formed within the third sleeve 146. Rotation of the cam 144*a* substantially 180° results in the elevation of the third sleeve 146. Elevation of the sleeve 146 results in a separation of the lower annular surface 146*d* of the third sleeve 146 and the upper annular surface 170*c* of the connector means 170. As the cam 144*a* rotates through its 180° travel by movement of the handle 144*d*, the uppermost portion 146*a'* of surface 146*a* of the third sleeve 146, seal 150 and port 148 no longer contact the uppermost portion of inner bore 140*a* of tubular member 140. In such an elevated position, the mixture entrapped within by-pass chambers 90, 92 can be forced therefrom by any suitable fluid flowing in the direction of arrow 202, therethrough the by-pass chambers 90, 92 in the direction of arrow 204, and being forced outwardly therefrom in the direction of arrow 206 through the radial ports 148. Thus, the camming means 144 elevates the third sleeve 146, the first sleeve 60 and the second sleeve 58 for effectively flushing entrapped material from within the by-pass chambers 90, 92 and outwardly therethrough radial ports 148. Of course, any other suitable mechanism for elevation of the sleeves 146, 60, 58 may be used in the alternative as long as the ports 148 are properly exposed to allow such "flushing" action. Furthermore, the operation of the cementing head H as described hereinabove is capable of being used if the casing 34 is simultaneously rotated and reciprocated or alternatively if it is rotated only or reciprocated only.

As illustrated, the cementing head H of the present invention may be used as a fluid head and not limited merely to the cementing of casing within a wellbore. In any situation requiring an internally flowing tubular fluid control member, the device of the present invention is ideal. As can be readily seen, the first sleeve 60 alone may easily be substituted as a primary flow control means as may the second sleeve 58 be substituted for a secondary flow control means either alone or in conjunction with the first sleeve 60. Similarly, the third sleeve 146 may be considered a third flow control means usable therewith the first and second sleeves 60, 58, respectively. Thus, the cementing head H of the present invention may be considered as one or a series of flow control means easily attachable and detachable for a variety of fluid flow applications.

Figure 8A:
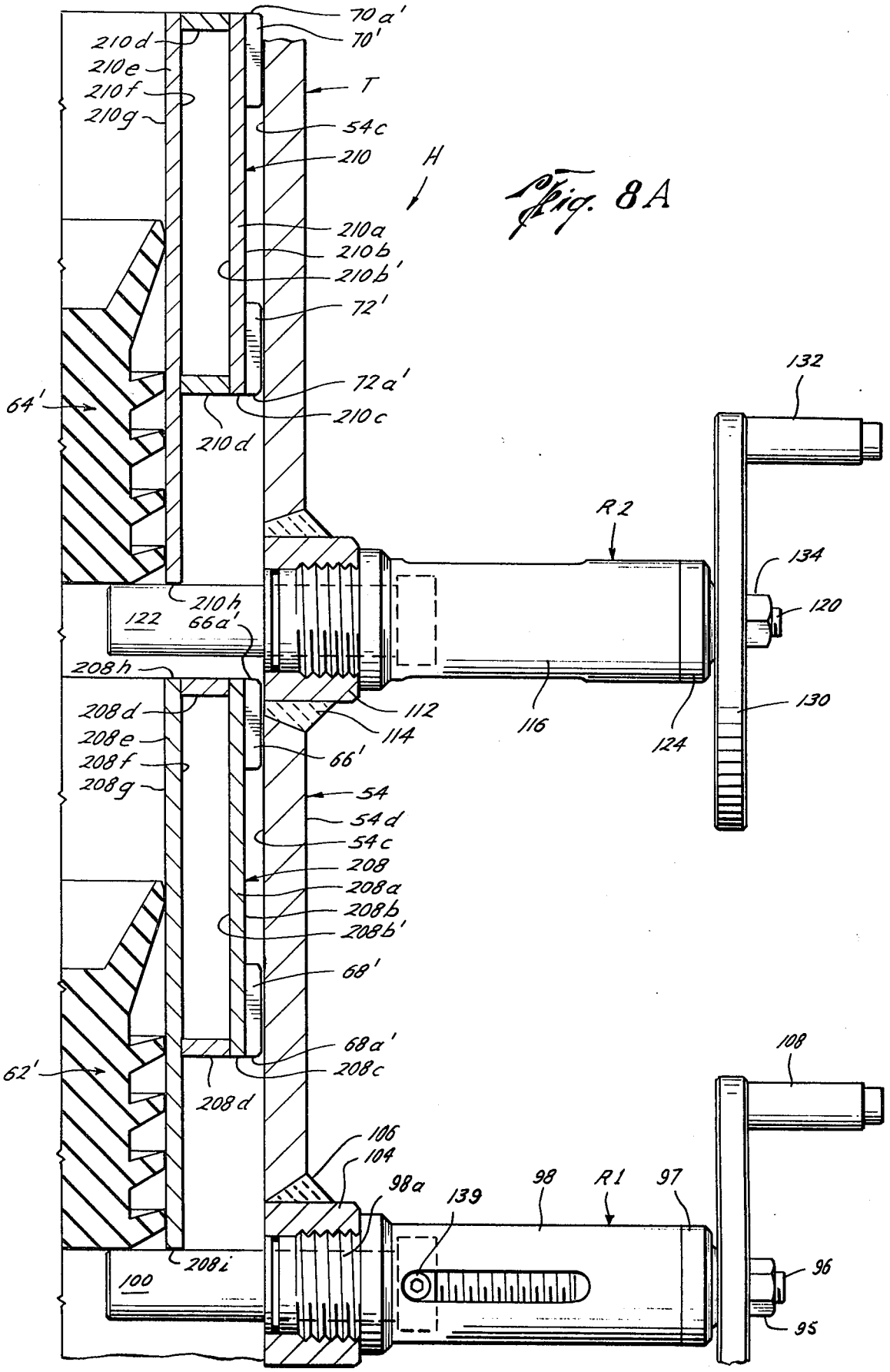
FIG. 8A shows an elevational sectional view of the cementing head of the present invention having substitute replacement plug-receiving sleeves therein the tubular housing for adapting the bore of the tubular housing to correspond to casings having smaller inside diameters than the bore of the tubular housing; and, FIG. 8B shows an elevational sectional view of the lower portion of the cementing head of the present invention as shown in FIG. 8A with the structure necessary to adapt the tubular housing to casings of smaller sizes.

The cementing head H of the present invention is adapted to be used with casing 34 having a variety of inside diameters equal to or smaller than the inner bore **60*b*, 58*b* of the first sleeve 60 and second sleeve 58, respectively. As shown in FIGS. 8A and 8B, the cementing head H is no different than the cementing head H of FIGS. 1–7 with respect to the tubular housing T, first releasable support R1 and the second releasable support R2. However, for the cementing head H to accommodate smaller diameter casing bores 34*b*, changes are necessary in the first sleeve 60, second sleeve 58 and third sleeve 146. In order to effectuate these changes it is necessary that the various portions of the tubular housing T being unthreadedly disconnected allowing replacement of sleeves 60, 58, 146 with appropriate replacement sleeves 208, 210, 212,** respectively.

First replacement sleeve 208 replaces first sleeve 60 having an outer sleeve **208*a* of the same physical dimensions as first sleeve 60 with centralizing lugs 66′, 68′ mounted on the outer cylindrical surface 208*b* of the outer sleeve 208*a* much as lugs 66, 68 are affixed to first sleeve 60. However, outer sleeve 208*a* extends only from the top portion 66*a*′ of the centralizing lug 66′ to the bottom portion 68*a*′ of the centralizing lug 68′ wherein the outer sleeve 208*a* is truncated at lower annular surface 208*c*. Spacer plates 208*d* separate the outer sleeve 208*a* from the inner sleeve 208*e* in spaced, concentric relationship with the spacer plates 208*d* being affixed to the outer cylindrical surface 208*f* of the inner sleeve 208*e* and the inner cylindrical surface 208*b*′ of the outer sleeve 208*a*. The inner bore 208*g* of the inner sleeve 208*e* is adapted to receive a first cement plug 62′ of a smaller diameter than first cement plug 62. By merely varying the thickness of the spacer plates 208*d* in conjunction with the appropriate diameter of inner sleeve 208*e* the cementing head H is capable of having a first plug-receiving sleeve S1 having various inner bore diameters, from that of the first sleeve 60 to that of replacement sleeve 208** or smaller.

In similar fashion, the second sleeve 60 may be appropriately replaced with replacement sleeve 210 having an outer sleeve **210*a* with outer cylindrical surface 210*b* where centralizing lugs 70′, 72′ may be appropriately mounted as are centralizing lugs 70, 72 with respect to the second sleeve 58. As with the first replacement sleeve 208, the second replacement sleeve 210 has an outer sleeve 210*a* which extends from the top portion 70*a*′ of the centralizing lug 70′ to the bottom portion 72*a*′ of the bottom centralizing lug 72′ wherein the outer sleeve 210*a* is truncated at lower annular surface 210*c* adjacent to the bottom portion 72*a*′ of the centralizing lug 72′ as compared to the second sleeve 58. Spacer plates 210*d* are mounted with inner cylindrical surface 210*b*′ of the outer sleeve 210*a* for mounting inner sleeve 210*e* in a spaced, concentric relationship. The spacer plates 210*d* are mounted with the outer cylindrical surface 210*f* of the inner sleeve 210*e* and the inner cylindrical surface 210*b*′ of the outer sleeve 210*a*. Further, the inner sleeve 210*e* has an inner bore 210*g* that is adapted to receive a second cement plug 64′ having a smaller diameter than second cement plug 64. Release of the second releasable support R2 results in the lower annular surface 210*h* of the inner sleeve 210*e* butting against upper annular surface 208*h* of the inner sleeve 208*e* of the first replacement sleeve 208 and resulting in inner bores 208*g*, 210*g*** being in substantially identical concentric, axial alignment and having substantially identical inner bore diameters.

The third sleeve 146, much as sleeves 60, 58, must also be replaced to accommodate smaller bore casing sizes. Third replacement sleeve 212 (FIG. 8B) is intended to replace the third sleeve 146. The third replacement sleeve includes an outer sleeve **212*a* that is substantially identical to third sleeve 146, having an upper, outer cylindrical surface 212*b*, lower outer cylindrical surface 212*c*, and seals 150′, 152′, 154′ disposed in the same relative position as seals 150, 152, 154 on third sleeve 146. The outer sleeve 212*a* further has an appropriately formed opening 212*d* for receiving the cam 144*a* of the camming means 144. Spacer plates 212*e* separate the outer sleeve 212*a* in spaced concentric relation from the inner sleeve 212*f*. The inner sleeve 212*f* includes an outer cylindrical surface 212*g* and an inner bore 212*h* and further includes an upper annular surface 212*i* and a lower annular surface 212*j*. The upper spacer plate 212*e* is formed having openings 212*e*′ therein corresponding to the radially formed ports 148′ formed within the outer sleeve 212*a* and radially formed ports 148″ formed within the inner sleeve 212*f*. Thus, with the ports 148′, 148″ and opening 212*e*′ in axial alignment, the outer sleeve 212*a* and the inner sleeve 212*f* may be appropriately mounted theretogether by a cap screw (not shown) or any other suitable means. Furthermore, it is preferable that seals 150″ and 152″ be in concentric relationship to seals 150′, 152′ with the seals 150″, 152″ being mounted with the upper spacer plate 212*e*. Furthermore, the upper spacer plate 212*e* has a lip portion 212*e*″ that is adapted to fit in butting relationship adjacent to the upper annular surface 212*k* of the outer sleeve 212*a*. Thus, the uppermost portion of the cleanout means C is the upper annular surface 212*e*‴ of the upper spacer plate 212*e* and the upper annular surface 212*i* of the inner sleeve 212*f*. These adjacent surfaces 212*i*, 212*e*‴ provide the supporting portion for the lower annular surface 208***i* of the inner sleeve 208*e* (FIG. 8A) when the first releasable support R1 is released and the first plug-receiving sleeve S1 moves from its upper, non-cementing position (FIG. 2B) to the lower, cementing position (FIG. 5) as described hereinabove.

Connector means 160′ is threadedly affixed to the threads 140*c* of the tubular member 140 with threads 170*b′* having seal 172′ for preventing fluid migration therebetween. Connector means 170′, in order to accommodate the smaller inner bore 170*e′*, is consequently of greater wall thickness than the original connector means 170. Resultant to the increased wall thickness of connector means 170′, upper annular surface 170*c′* is consequently of greater annular breadth and is for supporting lower annular surface 212*j* of the inner sleeve 212*f*, the lower annular surface 2121 of the outer sleeve 212*a*, as well as lower annular surface 212*e′′′′* of the lower spacer plate 212*e*. As with the above-described connector means 170, connector means 170′ have typical casing threads 170*b′* but have rough-cut coarse lower threads 170*f′* adapted to threadedly receive rough-cut coarse threads 176*a′* of the adapter 176′. As before, the adapted 176′ has an inner bore 176*c′* corresponding to the inner bore 170*e′* of the connector means 170′ which also corresponds with the smaller inner bore 34*b′* of the casing 34′. The adapter 176′ has typical threads 176*b′* on its lower portion and adapted to be threadedly mounted with threads 34*a′* of the casing 34′ having the smaller inner bore 34*b′*. Thus, the inner bore surfaces 210*g*, 208*g*, 212*h*, 170*e′*, 176*c′*, 34*b′* are in substantially matched concentric alignment providing an inner bore through the cementing head H of the present invention matching that of a casing 34′ having a smaller inner bore 34*b′* therein. Thus, by adjusting the replacement sleeves 208, 210, 212, connector means 170′, and adapter 176′ in accordance with the inner bore 34*b′* of the casing 34′, the cementing head H of the present invention may be used for a variety of smaller bore casings 34, while having all of the advantages and operational features of the cementing head H as described hereinabove with respect to FIGS. 1 through 7.

Thus, the cementing head H of the present invention is adapted to be simultaneously rotated and reciprocated in conjunction with the casing string for improved cementing operations thereof. The cementing head H incorporates a cleanout means C which helps to prolong tool life by providing a means for flushing excess residual cement from the inner portions of the cementing head H. Further, the cementing head H is adapted for being receivably mounted with casings having a variety of inner bore diameters. The cementing head H of the present invention is a relatively compact unit requiring no external valving and/or manifolds for proper cementing and distribution of fluid. The cementing head H of the present invention further eliminates many manufacturing problems incumbent with cementing heads having external valving and manifolds while further reducing stress on the tool by preventing radical fluid direction changes as is shown in the 90° bends of the manifold cited in the prior art. Thus, the cementing head H of the present invention provides a new and improved tool of promoting ease in cementing casing 34 within a wellbore 40 utilizing rotational and reciprocal action.

The foregoing disclosure and description of the invention are illustrative and explanatory thereof, and various changes in the size, shape and materials as well as in the details of the illustrated construction may be made without departing from the spirit of the invention.

I claim:

1. A cementing head for use in the cementing of casing in a wellbore, comprising:

a tubular housing having a longitudinal inner bore therethrough and adapted to be mounted longitudinally and having an upper end adapted to be connected for selectively receiving cement and drilling fluid and having a lower end adapted to be connected with the upper portion of the casing;

a first plug-receiving sleeve having a longitudinal bore therethrough for receiving a first cement plug and adapted to be mounted within said inner bore of said tubular housing for moving longitudinally from a non-cementing position to a cementing position;

a first releasable support means mounted with said tubular housing for releasably supporting said first sleeve in its non-cementing position and for moving out of contact with said sleeve;

said first sleeve having a first fluid by-pass means therewith and internally of said housing for directing fluid around said first sleeve when supported by said first releasable support means;

an annular seating surface in said housing separate from said first releasable support means;

said first sleeve being movable longitudinally to said cementing position upon the release of said first releasable support means from contact with said first sleeve and for movement into sealing engagement with said annular seating surface to close off the fluid directed around said first fluid by-pass means for thereafter directing the flow of cement through said bore of said first sleeve;

a second plug-receiving sleeve having a longitudinal bore therethrough for receiving a second cement plug and adapted to be mounted within said inner bore of said tubular housing for moving longitudinally from an upper position to a low position;

a second releasable support means mounted with said tubular housing for releasably supporting said second sleeve in its upper position;

said second sleeve having a second fluid by-pass means therewith and internally of said housing for directing cement around said second sleeve when supported by said second releasable support means; and, said second sleeve being movable longitudinally to said lower position upon the release of said second releasable support means to close off the cement directed around said second fluid by-pass means for thereafter directing the flow of fluid through said bore of said second sleeve.

2. The cementing head of claim 1 further including:

cleanout means mounted with said tubular housing for shifting said first sleeve for proper cleanout of cement between said inner bore of said tubular housing and said first and second fluid by-pass means of said first and said second sleeves, respectively, when said first and said second sleeves are each in said cementing and said lower positions, respectively.

3. The cementing head of claim 2, wherein said cleanout means further includes:

a third sleeve having a longitudinal bore therethrough and adapted to be mounted within said inner bore of said tubular housing thereunder said first sleeve, said third sleeve moving from a first non-cleanout position to a second cleanout position within said inner bore of said tubular housing, and said third sleeve further having a plurality of radial ports formed about the upper portion of said third sleeve for allowing cleanout of cement when said third sleeve is in said second cleanout position.

4. The cementing head of claim 3, wherein said cleanout means further includes:

camming means mounted with said tubular housing and said third sleeve for moving said third sleeve from said first non-cleanout position to said second cleanout position wherein said ports formed in said third sleeve allow discharge of cement through said inner longitudinal bore of said tubular housing.

5. The cementing head of claim 4, wherein said camming means includes:

a cam rotatably mounted with said tubular housing and adapted to be received in an opening formed in said third sleeve, the rotation of said cam resulting in upward longitudinal movement of said third sleeve from said first non-cleanout position to said second cleanout position.

6. The cementing head of claim 5, wherein:

said first sleeve has upper and lower annular surfaces and said second sleeve has upper and lower annular surfaces, said lower annular surface of said second sleeve engaging said upper annular surface of said first sleeve when said first and said second sleeves, respectively, are each in said cementing position and said lower position, respectively.

7. The cementing head of claim 6, wherein:

said third sleeve has upper and lower annular surfaces; and, said lower annular surface of said first sleeve engages said upper annular surface of said third sleeve when said first sleeve is in said cementing position and said third sleeve is in both said first non-cleanout position and said second cleanout position.

8. The cementing head of claim 3, wherein:

said first, second and third sleeves are removably mounted with said tubular housing allowing replacement of said first, second and third sleeves with substitute first, second and third sleeves, said substitute first, second and third sleeves having outer sleeves corresponding substantially to said first, second and third sleeves and inner sleeves concentric with said outer sleeves and mounted therewith said outer sleeves, said substitute sleeves permitting said inner bore of said tubular housing to be in substantial longitudinal alignment with casing bores having bores of various smaller inside diameters.

9. The cementing head of claim 1 further including:

connection means connected to the lower end of said tubular housing for facilitating the connection of said lower end of said tubular housing with the upper end of the casing, said connection means being muonted with the lower end of said tubular housing.

10. The cementing head of claim 9, wherein said connection means includes:

a tubular adapter having male threads corresponding to the female threads of the casing adjacent the upper end of the casing and the lower end of said adapter, said tubular adapter having coarse male threads adjacent the upper end of said adapter, said tubular housing having coarse female threads adjacent the lower end of said tubular housing corresponding to said coarse male threads of said adapter for facilitating the interconnection of said tubular housing with the casing.

11. The cementing head of claim 1 wherein:

said first fluid by-pass means includes a first chamber formed therebetween an outer annular surface of said first sleeve and said inner bore of said tubular housing; and, said second fluid by-pass means includes a second chamber formed therebetween an outer annular surface of said second sleeve and said inner bore of said tubular housing.

12. The cementing head of claim 11, further including:

a plurality of centralizing lugs radially disposed about said outer annular surface of said first sleeve between said outer annular surface of said first sleeve and said inner bore of said tubular housing in said first chamber; and, a plurality of centralizing lugs radially disposed about said outer annular surface of said second sleeve between said outer annular surface of said second sleeve and said inner bore of said tubular housing in said second chamber.

13. A fluid head for selective channeling of differing fluids therein directed into a tubular member, comprising:

a tubular housing having a longitudinal inner bore therethrough and adapted to be mounted longitudinally having an upper end adapted to be connected for selectively receiving differing fluids and having a lower end adapted to be connected with the upper portion of the tubular member;

primary flow control means having a longitudinal inner bore and mounted with said tubular housing for controlling fluid flow within the inner longitudinal bore of said tubular housing; and, said flow control means being releasably supported in a first position by a releasable support means mounted with said housing providing a fluid by-pass internally of said tubular housing, and upon release thereof, said releasable support means moving out of contact with said flow control means for longitudinal movement of said flow control means to a second position in engagement with an annular seating surface in said housing for closing said fluid by-pass and thereafter directing the fluid flow therethrough said longitudinal inner bore of said flow control means.

14. The fluid head of claim 13, further including:

a secondary flow control means having a longitudinal inner bore and mounted with said tubular housing for controlling fluid flow within the inner longitudinal bore of said tubular housing; and, said secondary flow control means being releasably supported in a first position above said primary flow control means providing a secondary fluid by-pass internally of said tubular housing, and upon release thereof, said secondary flow control means being longitudinally movable to a second position in engagement with said primary flow control means for closing said secondary fluid by-pass and thereafter directing the fluid therethrough said longitudinal inner bores of said primary and secondary flow control means.

15. The fluid head of claim 14, further including:

cleanout means including said annular seating surface mounted with said tubular housing for proper cleanout of fluid entrapped in said primary fluid by-pass and said secondary fluid by-pass of said primary and secondary flow control means, respectively, when said primary and said secondary flow control means are in said second positions, respectively.

16. The fluid head of claim 15, wherein said cleanout means further includes:

a third flow control means having said annular seating surface and a longitudinal inner bore and mounted with said tubular housing; and, said third flow control means being movably supported in a first non-cleanout position below said primary flow control means, said third flow control means being movable to a second cleanout position for directing the fluid entrapped in said primary fluid by-pass and said secondary fluid by-pass into said inner longitudinal bore of said tubular housing into the bore of the tubular member.

17. A cementing head for use in the cementing of casing in a wellbore, comprising:

a tubular housing having a longitudinal inner bore therethrough and adapted to be mounted longitudinally and having an upper end adapted to be connected for selectively receiving cement and drilling fluid and having a lower end adapted to be connected with the upper portion of the casing;

a first plug-receiving sleeve having a longitudinal bore therethrough for receiving a first cement plug and adapted to be mounted within said inner bore of said tubular housing for moving longitudinally from a non-cementing position to a cementing position;

a first releasable support means mounted with said tubular housing for releasably supporting said first sleeve in its non-cementing position;

said first sleeve having a first fluid by-pass means therewith and internally of said housing for directing fluid around said first sleeve when supported by said first releasable support means;

said first sleeve being movable longitudinally to sid cementing position upon the release of said first releaseable support means to close off the fluid directed around said first fluid by-pass means for thereafter directing a flow of cement through said bore of said first sleeve;

a second plug-receiving sleeve having a longitudinal bore therethrough for receiving a second cement plug and adapted to be mounted within said inner bore of said tubular housing for moving longitudinally from an upper position to a lower position;

a second releasable support means mounted with said tubular housing for releasably supporting said second sleeve in its upper position;

said second sleeve having a second fluid by-pass means therewith and internally of said housing for directing cement around said second sleeve when support by said second releasable support means;

said second sleeve being movable longitudinally to said lower position upon the release of said second releasable support means to close off the cement directed around said second fluid by-pass means for thereafter directing the flow of fluid through said bore of said second sleeve; and, deflector means mounted within said tubular housing for deflecting fluid flow through said first and second fluid by-pass means when said first sleeve is in said non-cementing position and said second sleeve is in said upper position to prevent a buildup of unnecessary forces on said first and said second releasable support means.

18. A fluid head for selective channeling of differing fluids therein directed into a tubular member, comprising:

a tubular housing having a longitudinal inner bore therethrough and adapted to be mounted longitudinally having an upper end adapted to be connected for selectively receiving differing fluids and having a lower end adapted to be connected with the upper portion of the tubular member;

primary flow control means having a longitudinal inner bore and mounted with said tubular housing for controlling fluid flow within the inner longitudinal bore of said tubular housing;

said flow control means being releasably supported in a first position providing a fluid by-pass internally of said tubular housing, and upon release thereof, said flow control means being longitudinally movable to a second position closing said fluid by-pass and thereafter directing the fluid flow therethrough said longitudinal inner bore of said flow control means;

a secondary flow control means having a longitudinal inner bore and mounted with said tubular housing for controlling fluid flow within the inner longitudinal bore of said tubular housing;

said secondary flow control means being releasably supported in a first position above said primary flow control means providing a secondary fluid by-pass internally of said tubular housing, and upon release thereof, said secondary flow control means being longitudinally movable to a second position closing said secondary fluid by-pass and thereafter directing the fluid therethrough said longitudinal inner bores of said primary and secondary flow control means;

cleanout means mounted with said tubular housing for proper cleanout of fluid entrapped in said primary fluid by-pass and said secondary fluid by-pass of said primary and secondary flow control means, respectively, when said primary and said secondary flow control means are in said second positions, respectively, wherein said cleanout means includes a third flow control means having a longitudinal inner bore and mounted with said tubular housing; and, said third flow control means being movably supported in a first non-cleanout position below said primary flow control means, said third flow control means being movable to a second cleanout position for directing the fluid entrapped in said primary fluid by-pass and said secondary fluid by-pass into said longitudinal bore of said tubular housing into the bore of the tubular member.

19. A cementing head for use in the cementing of casing in a wellbore, comprising:

a tubular housing having a longitudinal inner bore therethrough and adapted to be mounted longitudinally and having an upper end adapted to be connected for selectively receiving cement and drilling fluid and having a lower end adapted to be connected with the upper portion of the casing;

a first plug-receiving sleeve having an upper annular end and a longitudinal bore therethrough for receiving a first cement plug and adapted to be mounted within said inner bore of said tubular housing for moving longitudinally from a non-cementing position to a cementing position;

a first releasable support means mounted with said tubular housing for releasably supporting said first sleeve in its non-cementing position;

said first sleeve having a first fluid by-pass means therewith and internally of said housing for directing fluid around said first sleeve when supported by said first releasable support means;

said first sleeve being movable longitudinally to said cementing position upon the release of said first releasable support means to close off the fluid directed around said first fluid by-pass means for thereafter directing a flow of cement through said bore of said first sleeve;

a second plug-receiving sleeve having a lower annular end and a longitudinal bore therethrough for receiving a second cement plug and adapted to be mounted within said inner bore of said tubular housing for moving longitudinally from an upper position to a lower position;

a second releasable support means mounted with said tubular housing for releasably supporting said second sleeve in its upper position;

said second sleeve having a second fluid by-pass means therewith and internally of said housing for directing cement around said second sleeve when supported by said second releasable support means; and, said second sleeve being movable longitudinally to said lower position upon the release of said second releasable support means to engage said lower annular end of said second sleeve with said upper annular end of said first sleeve to close off the cement directed around said second fluid by-pass means for thereafter directing the flow of fluid through said bore of said second sleeve.

* * * * *